US005272883A

United States Patent [19]

Matsui et al.

[11] Patent Number: 5,272,883

[45] Date of Patent: Dec. 23, 1993

[54] METHOD AND APPARATUS FOR MAINTENANCE OF INDOOR SKI SLOPES

[75] Inventors: Nobuyuki Matsui, Tokyo; Kazunobu Abe, Tokyo; Makoto Kayo, Tokyo; Osamu Sakaguchi, deceased, late of Osaka; Itsuko Sakaguchi, legal representative, Toyoshina; Yasuharu Kiso, Osaka; Masaya Hiraoka, Osaka, all of Japan

[73] Assignee: Kajima Corporation, Tokyo, Japan

[21] Appl. No.: 854,803

[22] Filed: Mar. 19, 1992

Related U.S. Application Data

[63] Continuation-in-part of Ser. No. 616,668, Nov. 21, 1990, abandoned.

[30] Foreign Application Priority Data

Nov. 22, 1989 [JP] Japan ..... 1-302192

[51] Int. Cl.[5] ..... F25C 1/00; F25C 3/04

[52] U.S. Cl. ..... 62/74; 62/235; 239/2.2

[58] Field of Search ..... 62/235, 121, 74, 348; 239/2.2

[56] References Cited

U.S. PATENT DOCUMENTS

| | | | |
|---|---|---|---|
| 2,676,471 | 4/1954 | Pierce, Jr. | 62/121 X |
| 4,742,958 | 5/1988 | Bucceri | 239/2.2 |
| 4,785,641 | 11/1988 | McDougal | 62/347 X |
| 4,914,923 | 4/1990 | Duplan et al. | 62/235 |

*Primary Examiner*—William E. Wayner
*Attorney, Agent, or Firm*—James H. Tilberry

[57] ABSTRACT

A method and apparatus for the maintenance of snow quality on an indoor artificial ski slope. The snow quality of the slope, comprising a thin compacted surface layer and a deep unfused base layer, is maintained by promptly managing against the variations of snow quality due to various heat sources. The old surface layer snow is replaced with fresh snow on a daily basis, while deterioration of the snow base layer is prevented by air conditioning and refrigeration means. The old snow is melted, filtered, and used to make new snow, to air condition the slope, and to expedite melting of yet additional old snow.

16 Claims, 2 Drawing Sheets

METHOD AND APPARATUS FOR MAINTENANCE OF INDOOR SKI SLOPES

This is a continuation-in-part of Ser. No. 07/616,668, filed Nov. 21, 1990, now abandoned.

BACKGROUND OF THE INVENTION

1. Field of the Invention

The field of invention relates in general to methods and apparatus for making snow, and, in particular, to methods and apparatus for maintaining ski slope snow quality in indoor skiing facilities.

2.Description of the Prior Art

It has been generally known that indoor ski slopes are covered with artificial snow in an enclosed area cooled to below 0° C. in order to maintain the snow quality. In order to maintain an indoor slope at below 0° C., it must be insulated from various sources of heat, such as exterior walls; the ground underlying the slope; latent and sensible heat of water droplets and indoor water vapor; generated and radiated heat of indoor machinery; and heat generated by skiers and ski slope personnel. These sources of unwanted heat must be dealt with by adequate air conditioning.

With adequate air conditioning equipment, artificial snow on the surfaces of skiing runway slopes ordinarily does not melt from heat derived from the ambient atmosphere, since the atmosphere is maintained at a freezing temperature. However, the snow quality does change due to the sintering of snow crystals caused by the pressure and friction applied to the surface of the snow by the weight of the skiers. Radiation heat from illumination will also change the quality of the snow.

The snow on a ski slope comprises a base of unfused, unpacked snow, which could be 30 cm or more in depth, and a thin packed surface crust about 1 cm thick. It is the condition of the crust that provides the "feel" of the slope sensed by skiers through their skis. Even though an indoor ski slope is fully air conditioned to a temperature below 0° C., the quality of the top crust will eventually deteriorate by the wear imposed on the snow by the skiers. The unfused snow base beneath the crust, on the other hand, will deteriorate from invasion of heat from the ground underlying the ski slope. Accordingly, there has been a felt need for means to condition both the crust and the base of artificial snow to prolong its useful life and to reconstitute the snow after it has deteriorated beyond use.

SUMMARY OF THE INVENTION

For the maintenance of ski slope snow quality in indoor artificial skiing facilities according to the present invention, the replacement of both the crust and base snow is accomplished as follows:

1. The replacement of the old crust snow with fresh snow.

The replacement of the crust, or cover snow, portion of the ski slope is accomplished by removing the sintered surface layer of existing snow and by simultaneously producing and covering the slope with the same amount of fresh snow. The sintered snow is removed with a track laying vehicle equipped with a front-mounted ice shaving blade.

For the production of replacement artificial snow, snow quality close to that of natural snow is obtained by using a method for freezing fine mist water droplets. Both the latent and the sensible heat transfer necessary to freeze water droplets must be taken into consideration in selecting air conditioning facilities with adequate capacity.

The sintered snow removed from the slope is melted simultaneously with the production of new snow so that the latent heat energy transfer required to produce new snow is offset by the latent heat energy transfer required to melt the old snow, estimated to be approximately 80K calories per liter of water, so less energy is required.

2. Securing snow quality of the unfused base snow.

(a) Cooling by air conditioning.

Air conditioning ducts are mounted above the ski slope and the air space therebetween is maintained below the freezing point, thereby preventing the invasion of outside air into the space above the slope bed surface.

(b) Cooling by Slope Refrigerant Pipes.

Heat invasion from beneath the slope bed surface is prevented by embedding cooling refrigerant pipes within the slope bed for direct cooling of the slope.

Either or both of these methods may be used.

OBJECTS OF THE INVENTION

It is among the objects of the invention to provide a method and facilities for maintaining the snow quality of a ski slope by keeping in good condition both the cover snow portion on the surface and the unfused snow portion constituting the subjacent snow base of the slope and to promptly manage against the variation of the snow quality due to the sintering of snow crystals caused by various heat sources.

BRIEF DESCRIPTION OF THE DRAWINGS

The foregoing and other objects and features of the invention will become apparent from the following description of preferred embodiments of the invention with reference to the accompanying drawings, in which.

DETAILED DESCRIPTION OF PREFERRED EMBODIMENTS

Figure 1:
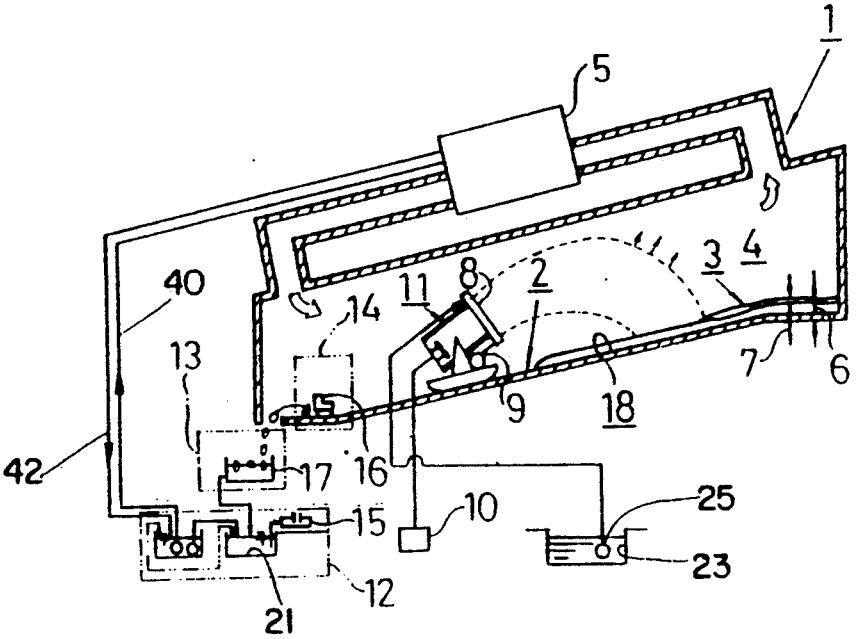
FIG. 1 is a schematic elevational view in section showing a maintenance facility in an indoor artificial ski slope in accordance with a preferred embodiment of the invention.

Referring to FIG. 1, snow coverage 3 on a slope 2 in a properly operated indoor artificial skiing facility 1 should not melt because the enclosed slope area is always maintained at or below 0° C. by means of air conditioning equipment 5. However, the snow quality deteriorates for a variety of reasons, such as snow sintering caused by compaction of the snow by skiers; air borne dust; cotton flue from skiwear; ski wax; and other such foreign contaminants. Foreign contaminants first accumulate on the surface of the slope, but thereafter are intermixed with the upper layer of snow, primarily due to churning caused by skiers and by snow-grooming machines. As the snow quality deteriorates, it is necessary to restore snow quality in order to maintain the ski slope in suitable skiing condition.

The cover snow portion is first scraped from the underlying base of snow by a bulldozer-type grooming machine and pushed onto a snow melting ramp at the base of the slope. Since the ambient temperature of the snow is maintained at 0° C. to 6° C., snow contaminants are maintained in a solid state, and thus do not migrate into the under layer of base snow. Therefore, most, if not all, of the contaminants are removed from the slope with the old cover snow.

As shown in FIG. 1, snow coverage 3 of slope 2 is divided into an unfused snow base portion 6 and a cover of packed snow 7 by which skiers judge the quality of the skiing conditions. After the unfused base snow portion 6 has been initially put in place on the slope, no daily maintenance should be necessary.

Several considerations govern the replacement, supplementation, and reproduction of the cover of packed snow 7, including decreased frictional resistance on the skiing surface caused by the frictional heat, the radiation heat of illumination, the reduction of the thickness of the cover snow portion 7, and its contamination.

The preferred embodiment of the invention shown in FIG. 1 comprises air conditioning apparatus 5 for maintaining the enclosed slope area 4 at below 0° C.; an air blower 8; a compressed air supply 9; electrical facilities 10; a water supply 12 for snow producing device 11; a snow melting device 13 for supplying water to the water supply 12; and a snow supply station 14 for supplying snow to the snow melting device 13.

The maintenance facility is operated in a closed cycle in which the melting and producing of snow are interrelated. Theoretically, the snow production under ideal circumstances may be entirely sustained by using water obtained from melting of the snow. Thus the amount of newly made snow will be derived entirely from the water recovered from the melting of snow. However, as a practical matter, clean fresh snow cannot be produced solely from melted snow due to the aforementioned contaminants. For this reason, in the water supply 12 approximately only two thirds of the amount of snow produced comes from recycled water obtained from the snow melting device 13, and the remaining one third comes from supplied fresh water. The replaced contaminated water is released into a septic tank or other suitable water disposal system.

The temperature of the water for producing snow by the snow producing device 11 ranges from 0° to +4° C. Accordingly, the water supply 12 is provided with a water supply cooling system 15 for keeping the water supply at less than 2° C. However, the water for producing snow to be supplied to the snow producing device 11 after the slope is closed to skiers is cooled by the heat transfer from the melting snow. The water for producing snow in the unfused snow portion 6, when the slope is closed to skiers, is cooled by a refrigerator (not shown) in the air conditioning equipment.

Figure 2:
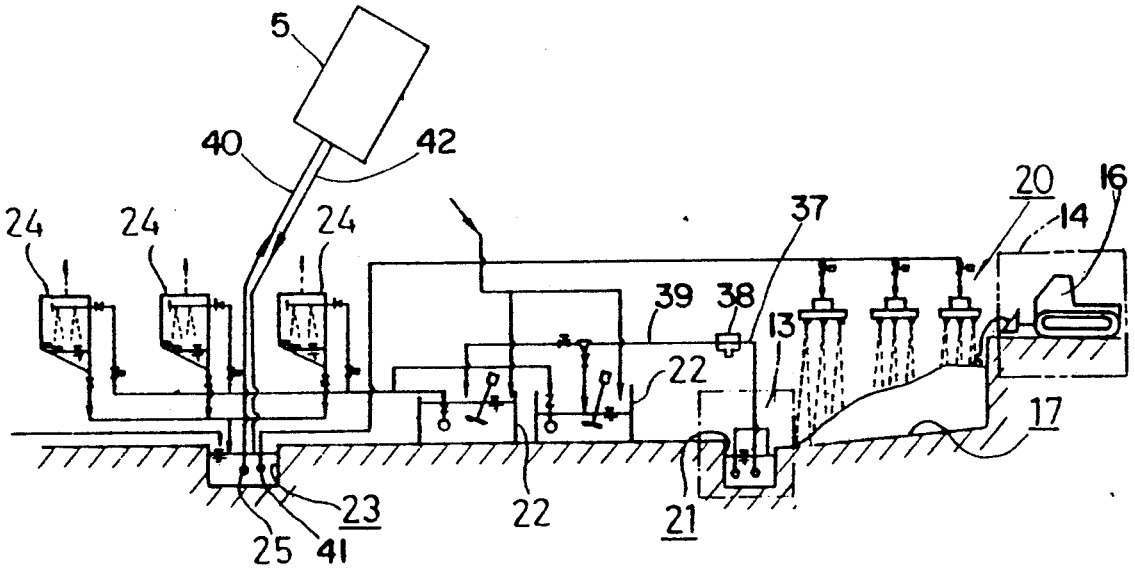
FIG. 2 is a schematic elevational view showing a means for collecting and melting snow in accordance with a preferred embodiment of the invention.
Figure 3:
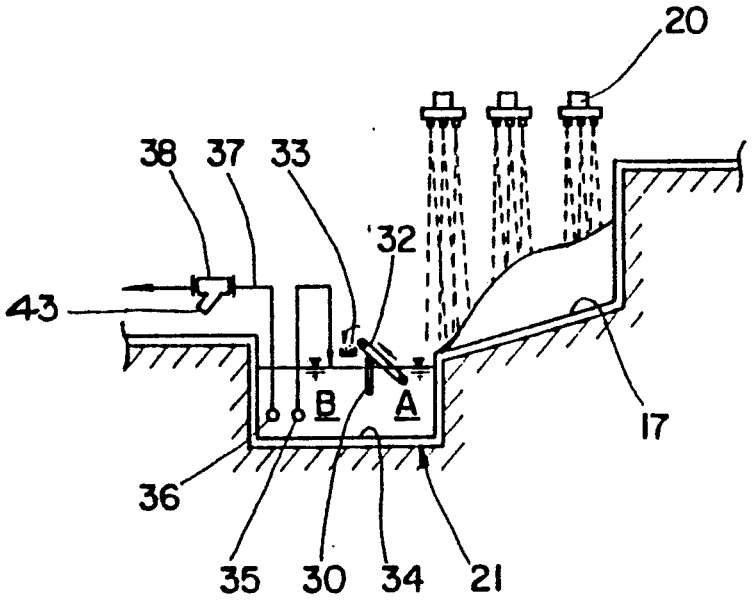
FIG. 3 is an enlarged elevational fragmentary view in section of the snow melting and filtering means of FIG. 2.

In the snow melting device 13, FIGS. 1 and 2, the layer of contaminated and/or sintered snow is bulldozed to the lowest position of the slope to snow storage area 14, from where it is fed onto a snow melting ramp 17 by a slope maintenance bulldozer 16. In FIG. 2, snow melting jets 20 melt the snow previously pushed onto the snow melting ramp 17. A tank 21 collects the melted snow from the snow melting ramp 17, where it is screened and filtered before being pumped to a cooling water tank 22. As shown in FIG. 3, a baffle 30 separates tank 21 into A and B compartments and is vertically positioned to prevent floating contaminants from escaping from compartment A to compartment B. A rotating endless belt conveyor screen 32 skims floating contaminants from the surface of compartment A and conveys them to a trough 33 for disposal into a septic system, not shown.

Non-floating contaminants migrate to chamber B, where they are prevented from settling to the bottom 34 of tank 21 by circulating pump 35. The melted snow is then removed from compartment B of tank 21 by means of pump 36 through pipe line 37 into a strainer 38 where the remaining contaminants are strained, and then removed through drain bypass 43 for disposal to the septic system. The filtered melted snow is then carried through pipe line 39, FIG. 2, into cooling water tank 22, as aforesaid. Water from the water cooling tank is passed through condensers 24 into a collecting tank 23, to which supplemental water is added. Pump 25 passes the water from collecting tank 23, through pipe line 40 to the air conditioning device 5, FIG. 1, and the water returns through pipe line 42. Pump 41 passes water from collecting tank 23 to snow melting jets 20.

The heat transfer of melting snow is utilized for the cooling of snow production water to be supplied to the snow producing device 11, for the cooling water for the air conditioning device 5, and for the snow melting jets 20.

Contaminated and/or sintered snow is cut from the slope and formed into snow piles in storage area 14 at a rate consistent with the snow melting capacity of the snow melting ramp 17. In this preferred embodiment, a slope maintenance bulldozer 16 is used for working the snow piles and feeding snow from the snow piles onto the snow melting ramp 17. In the alternative, a screw feeder (not shown) may be used for faster feeding the snow piles to the snow melting ramp 17.

Figure 4:
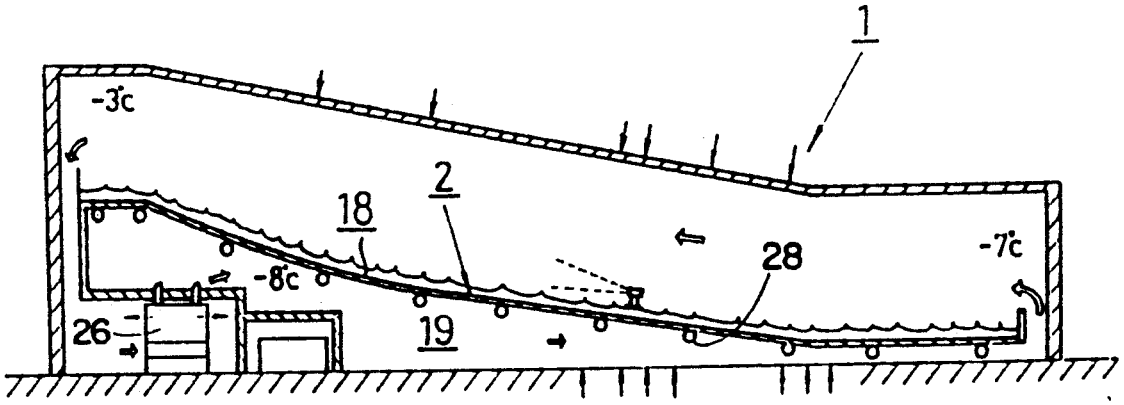
FIG. 4 is a schematic elevational sectional view showing another preferred embodiment of the invention for maintaining snow quality by managing against heat invasion from the slope bed surface and undersurface.

FIG. 4 shows a ski slope bed 18 and an air conditioning chamber 19 beneath the bed 18. As shown by the arrows, conditioned air cools the underside of bed 18 by passing from left to right. The air then circulates over the top of the bed 18 from right to left, whereupon it is recooled in air conditioner 26.

In another preferred embodiment of the invention, cooling pipes 28 are placed in, or secured to the underside of, the bed 18 to prevent a transfer of heat from beneath the bed to the snow base on the top surface of the bed. Cooling pipes 28 may be employed in lieu of, or as a supplement to, air conditioner 26.

The quality of the packed snow portion 7 and the unfused snow portion 6 on the slope 2 is the criterion for selecting either of the air conditioning means 5 and/or 26, or cooling pipes 28 in addition to air conditioning means 5 and/or 26, to manage against heat invasion of the slope bed 2 and the snow carried by the bed surface 18.

It will occur to those skilled in the art, upon reading the foregoing description of the preferred embodiments of the invention, taken in conjunction with a study of the drawings, that certain modifications may be made to the invention without departing from the intent or scope of the invention. It is intended, therefore, that the invention be construed and limited only by the appended claims.

What is claimed is:

1. A method for maintaining the snow quality of a slope in an indoor artificial skiing facility, comprising the steps of:

dividing the snow covered portion of said slope of said artificial skiing facility into a compacted snow portion on its surface layer and an unfused snow portion in its deep layer; and replacing old compacted snow with fresh snow and maintaining the security of the snow quality in said unfused snow portion;

wherein the replacement of said compacted snow portion is accomplished by removing the surface layer of existing compacted snow coverage having sintered snow crystals by means of a maintenance vehicle with a snow scraping blade, and producing the same amount of artificial snow as removed by said maintenance vehicle and at the same rate as the snow removal by said maintenance vehicle;

the latent heat which is obtained by melting the same amount of removed snow as that of said fresh snow at the same time that fresh snow is produced, is recovered for cooling use, said artificial snow being produced at the same time by freezing misty water droplets; and said snow quality in said unfused snow portion is secured by preventing the invasion of outside heat from the slope bed surface by selecting either the method of forming a space under the bed for an air-conditioning duct at an atmosphere below a freezing point, or disposing cooling pipes within said slope bed for positively cooling said slope bed.

2. Means for maintaining the snow quality of a slope in an indoor artificial skiing facility, comprising:

a slope air-conditioning device for keeping said skiing facility at or below 0° C.;

a snow producing device including an air blower portion, a compressed air supply portion and electrical facilities;

a water supply device for supplying water to said snow producing device;

a snow melting device for preparing water to be supplied to said water supply device; and a snow supply device for supplying snow to said snow melting device;

said snow supply, snow melting, and water supply devices being operable in a closed cycle to supply water to said snow producing device, wherein said water supply device is so adapted that substantially two thirds of the produced snow comes from said snow melting device and substantially one third comes from supplemental water.

3. Means for maintaining the snow quality of a slope in an indoor artificial skiing facility, comprising:

a slope air-conditioning device for keeping said skiing facility at or below 0° C.;

a snow producing device including an air blower portion, a compressed air supply portion and electrical facilities;

a water supply device for supplying water to said snow producing device;

a snow melting device for preparing water to be supplied to said water supply device; and a snow supply device for supplying snow to said snow melting device;

said snow supply, snow melting, and water supply devices being operable in a closed cycle to supply water to said snow producing device, wherein said snow supply device stores snow at the lowest position of the slope, and said snow melting device prepares supply water by transferring said stored snow to a snow melting ramp for melting treatment.

4. Means for maintaining the snow quality of a slope in an indoor artificial skiing facility, comprising:

a slope air-conditioning device for keeping said skiing facility at or below 0° C.;

a snow producing device including an air blower portion, a compressed air supply portion and electrical facilities;

a water supply device for supplying water to said snow producing device;

a snow melting device for preparing water to be supplied to said water supply device; and a snow supply device for supplying snow to said snow melting device;

said snow supply, snow melting, and water supply devices being operable in a closed cycle to supply water to said snow producing device, wherein said snow melting device comprises: a snow melting ramp, snow melting jet means for melting snow transferred to said snow melting ramp, a downside channel for collecting snow melted on said snow melting ramp, a cooling water tank to which said water resulting from melting of snow is sent, a condenser, a cooling effluent tank to which said water resulting from melting of snow is sent from said cooling water tank through said condenser, means to simultaneously supplement water to said cooling effluent tank, and a pump for forwarding said water resulting from melting of snow to said snow melting jet device and to said slope air-conditioning device.

5. Means for maintaining the snow quality of a slope in an indoor artificial skiing facility, comprising:

a slope air-conditioning device for keeping said skiing facility at or below 0° C.;

a snow producing device including an air blower portion, a compressed air supply portion and electrical facilities;

a water supply device for supplying water to said snow producing device;

a snow melting device for preparing water to be supplied to said water supply device; and a snow supply device for supplying snow to said snow melting device;

said snow supply, snow melting, and water supply devices being operable in a closed cycle to supply water to said snow producing device, wherein said snow supply device feeds snow at the rate of the snow melting capacity of said snow melting device.

6. The method of maintaining the snow quality of an enclosed artificial ski slope having a base of unfused snow and a surface layer of compacted snow, comprising the steps of:

(a) scraping said surface layer of compacted snow onto a snow collection ramp;

(b) melting said collected snow;

(c) filtering contaminants from said melted snow for reuse of the melted snow in a snow-making device;

(d) adding supplemental water to said melted snow; and (e) supplying a snow making device with the said melted snow.

7. The method of claim 6, including the step of utilizing the latent heat of melting snow to cool the filtered water supplied to said snow producing device.

8. The method of claim 6, including the step of supplying water to said snow producing device in the ratio of substantially two thirds melted filtered snow and substantially one third supplemental water.

9. The method of claim 6, including the step of utilizing the latent heat of melting snow to accelerate the melting of said collected snow.

10. The method of claim 6, including the step of utilizing the latent heat of melting snow to refrigerate said ski slope.

11. The method of claim 6, including the step of supplying said supplemented filtered water to a snow producing device at the rate of melting of said collected snow.

12. The method of claim 6, including the steps of recovering filtered water and making snow within a closed cycle.

13. The method of claim 6, including the step of utilizing the latent heat of melting snow to air condition enclosed space about said artificial ski slope.

14. The method of claim 6, including the steps of supplying air conditioning means for said ski slope with a supply of said filtered water recovered from said melted snow to operate said air conditioning means, and supplying jet water spray means with a supply of said filtered water recovered from said melted snow to expedite melting of yet additional snow.

15. The method of claim 14, wherein said air conditioning means circulates cooled air above and below said ski slope.

16. The method of claim 14, wherein said air conditioning means comprises cooling pipes secured to the underside of said ski slope.

* * * * *